United States Patent [19]

Johansson

[11] Patent Number: 4,764,136

[45] Date of Patent: Aug. 16, 1988

[54] MARINE DRIVE MEANS

[76] Inventor: Donald Johansson, Fågelvägen 10, S-138 00 Älta, Sweden

[21] Appl. No.: 10,853

[22] Filed: Feb. 4, 1987

[51] Int. Cl.[4] ..... B63H 21/32

[52] U.S. Cl. ..... 440/89

[58] Field of Search ..... 440/53, 55, 56, 57–66, 440/88, 89, 112, 113; 60/280

[56] References Cited

U.S. PATENT DOCUMENTS

| | | | |
|---|---|---|---|
| 3,181,495 | 5/1965 | Kiekhaefer | 440/57 |
| 3,183,880 | 5/1965 | Shimanckas | 440/64 |
| 3,396,693 | 8/1968 | Bergstedt | 440/53 |
| 4,178,873 | 12/1979 | Bankstahl | 440/89 |

*Primary Examiner*—Sherman D. Basinger
*Assistant Examiner*—Jesûs D. Sotelo
*Attorney, Agent, or Firm*—Sherman and Shalloway

[57] ABSTRACT

The invention relates to a marine drive comprising a water-cooled internal combustion engine mounted in a boat, a shield mounted on the transom stern of the boat and supporting a universal joint housing and a pinion box connected to the universal joint housing and comprising a propeller arranged to be immersible in the water, an exhaust piping connected between the engine and the exhaust outlet carrying off exhaust and cooling water from the engine. The exhaust piping comprises a first part passing from the engine through the shield and associated with a second part passing through the pinion box and ending at the exhaust outlet, the connection between the first and the second part of the exhaust piping being open at least partly in order to unload the pressure in the pipe and to let out cooling water.

7 Claims, 1 Drawing Sheet

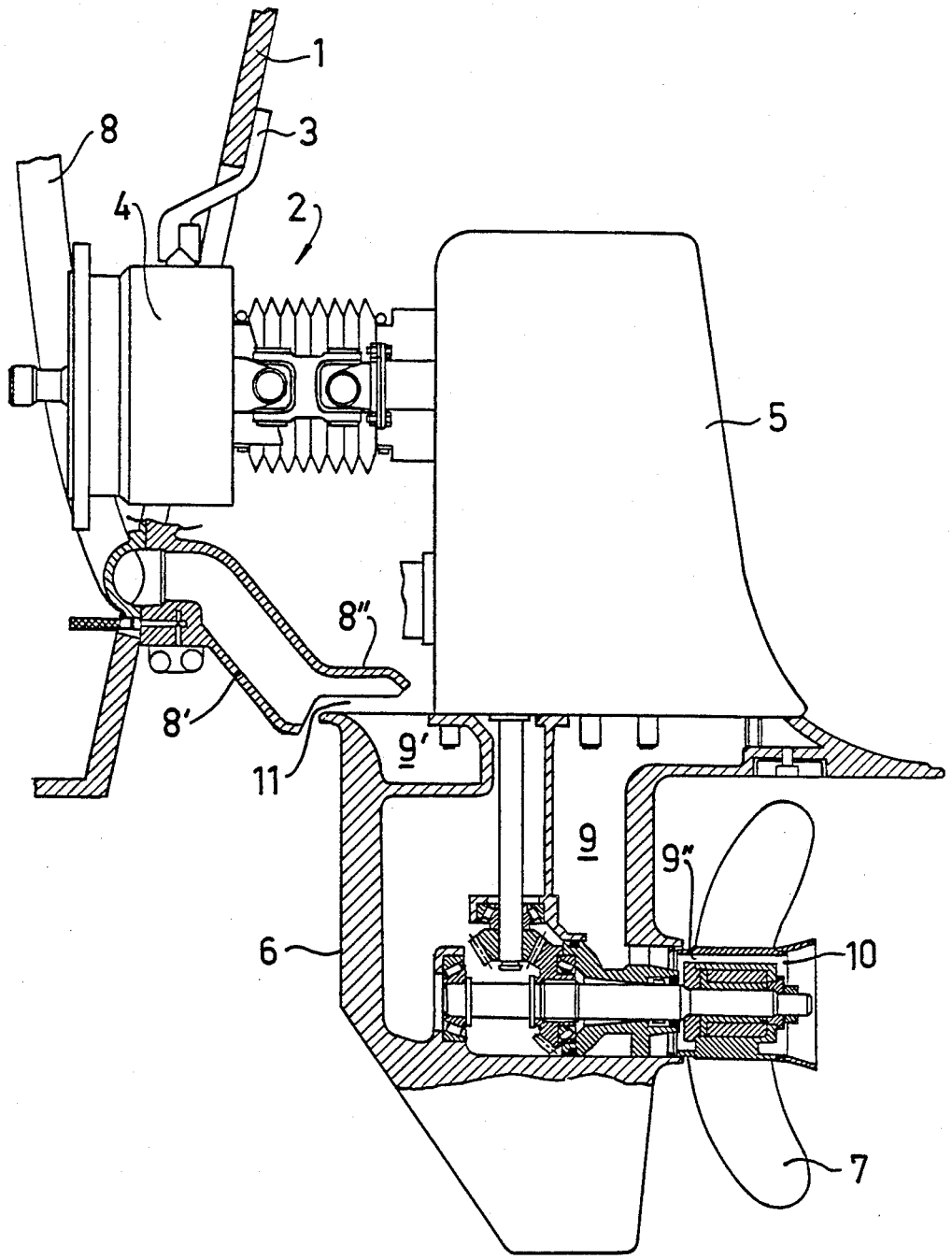
1
3
8
4
2
5
8''
8'
11
9'
9
9''
6
10
7

MARINE DRIVE MEANS

This invention relates to a marine drive means, especially the exhaust system of such a marine drive means comprising a water-cooled internal combustion engine mounted within a boat and provided with a drive unit mounted in the stern, a so-called inboard-outboard drive system.

It is usual in marine driving devices of the above mentioned type to lead away exhaust and cooling water under the water in order to reduce the sound level. In these systems it has recently become usual to lead the exhaust gases and the cooling water through an exhaust piping passing out of the boat through the shield in which the driving unit is mounted, then further through the driving unit and ending with an exhaust outlet at the centre of the propeller. Moreover, it is claimed that these systems increase the propulsion power as the exhaust gases and the cooling water discharged through the propeller contribute to a jet effect. What is then not taken into account is the considerable counterpressure formed in the exhaust system partly due to the fact that the exhaust port at its end at the propeller usually has only an area that is about 50% of the corresponding area directly after the outblow of the engine. This increase of pressure in the exhaust system will then brake the engine which is synonymous with a decrease of the motor power and, moreover, said increase of power further contributes to the exhaust noise being heard more.

It has therefore been the object of the invention to provide a marine drive means, the exhaust system of which is so embodied, on one hand, that it does not give any braking effect on the engine and, on the other hand, that the sound level is kept as low as possible.

This object of the invention has been achieved in that the invention has been given the characteristic features defined in the claims.

Thanks to the fact that the invention in one embodiment is formed so that the connection between the first and the second part of the exhaust piping is open at least partly in order to unload the pressure in the piping and to let out cooling water the pressure in the exhaust piping is lowered and does not cause any braking moment on the engine. As the exhaust piping is open a negative pressure is obtained in the other part of the exhaust piping due to the ejector effect of the propeller, and this negative pressure will then create a negative pressure also at the beginning of the second part of the exhaust piping close to the opening to the first part of the exhaust piping which negative pressure attracts exhaust and noise. Moreover, when cooling water is let out a water curtain is formed that will muffle the sound further.

As, according to another embodiment of the invention, the cross-sectional area of the first part of the exhaust piping increases from the engine towards the connection to the other part of the exhaust piping it is ensured that the exhaust gases can expand freely and not exert any braking moment on the engine.

In one embodiment the exhaust system is so designed that the size of the opening between the first and the second part of the exhaust piping is such that substantially all cooling water leaves the exhaust piping through the opening and the dimension of the exhaust outlet in the propeller is such that a negative pressure is created in the other part of the exhaust piping at the rotation of the propeller, the connection between the first and the second part of the exhaust piping being formed in that the first part of the exhaust piping terminates in a substantially horizontal piping section where at least one part of the lower wall portion of this pipe section is removed and that the other part of the exhaust piping at the connection to the first part is formed as a pipe section that is substantially upwardly open towards the remaining upper part of the first horizontal pipe section. Through this embodiment where the main portion of the cooling water leaves the exhaust piping through the opening at the connection between the first and second part of the exhaust piping and where a pressure release also takes place, a substantially closed space above the inlet to the second part of the exhaust piping is formed by the water curtain streaming out and the pinion box. This closed space is associated with the exhaust outlet in the propeller via the second part of the exhaust piping, and through this second part of the exhaust piping a negative pressure is formed in the closed space owing to the rotation of the propeller, said negative pressure sucking out the exhaust through the second part of the exhaust piping and out through the propeller. It has very surprisingly also been found that the noise level is reduced very remarkably through this design.

Other characteristic features and advantages of the invention will appear to one skilled in the art with reference to the following detailed description in connection with the drawing, wherein the only FIGURE is a lateral view, partly in section, of a marine drive means according to the invention. Only the parts of the invention that are essential are shown in detail.

Thus, on the drawing there is shown part of a marine drive means mounted at a boat with a transom stern 1. The marine drive means is of a type mounted in the stern or of inboard/outboard type. The drive means comprises a water-cooled internal combustion engine not shown which is mounted within the boat, and a power transmission 2 passing through a shield 3 mounted on the transom stern of the boat, said shield 3 supporting a universal joint housing and a propulsion unit 5 connected to said housing. The propulsion unit 5 comprises a pinion box 6 rotatable relative to the transom stern 1 of the boat, the driving propeller 7 also being mounted on said pinion box 6.

At least one exhaust piping leads from the engine. The first part 8 thereof goes from the motor and out through the shield 3 where it is associated with a second part 9 of the exhaust piping which continues through the pinion box 6 and emerges in the exhaust outlet 10 in the propeller 7.

As is apparent from the drawing figure the connection between the first part 8 and the second part 9 of the exhaust piping is open at least partly in order that the major portion of the cooling water might be drawn at the opening 11 and the pressure in the piping also be released. Besides, the first part 8 of the exhaust piping is embodied so that its cross-sectional area increases from the engine to the opening 11 and the connection to the other part 9. Immediately before the opening 11 the cross-sectional area of the first part 8 of the exhaust piping can for instance be 50% larger than the cross-sectional area of the piping close to the engine. As is apparent from the drawing figure the first part 8 of the exhaust piping terminates with a downwardly inclined portion 8' passing into a substantially horizontal portion 8'', in which the lower portion of the wall of the pipe section has been removed. In this way the first part 8 of the exhaust piping terminates in a pipe section 8'' that is substantially open downwards.

The other part 9 of the exhaust piping starts close to the first part 8 of the exhaust piping with a substantially vertical, upwardly open pipe section 9', and the second part then continues down through the pinion box 6 and emerges in a substantially annular exhaust port 9'' in the propeller. As is apparent from the drawing figure the upper portion 9' of the first portion of the second part 9 extends somewhat further upwards than the lower portion of the pipe section 8'' of the first part. As is also apparent from the drawing figure a space 11 open both in vertical and horizontal direction is formed between the first and the second part of the exhaust piping and the two parts 8, 9 of the exhaust piping are completely without any direct contact with one another. The cross-sectional area of the second part 9 of the exhaust piping can be only e.g. 50% of the cross-sectional area of the first part 8 of the exhaust piping close to the engine as the maximum cross-sectional area of the second part 9 of the exhaust piping is defined by the available space in the outlet 9'' at the centre of the propeller 7.

When the engine is in operation and loaded to propel the boat exhaust gases and cooling water will stream under a high pressure through the first part 8 of the exhaust piping. Thanks to the fact that the cross-sectional area of this increases from the engine to the opening 11 to the second part 9 there is no risk that any counterpressure build-up in the exhaust piping will take place but the engine can operate undisturbed by counterpressure from the exhaust gases. When the exhaust gases and the cooling water reach the opening 11 between the first part 8 and the second part 9 of the exhaust piping the water will substantially stream out through the opening in front of the starting end of the second part 9 of the exhaust piping. On the other hand, the exhaust gases tend to stream further into the space between the first part 8 and second part 9 of the exhaust piping lying substantially in the horizontal plane and further down through the second part 9 of the exhaust piping. Moreover, the ejector effect provided by the rotation of the propeller 7 contributes to this, said ejector effect creating suction through the second part 9 of the exhaust piping and forming a negative pressure in the space 11 between the first section 8 and second section 9 of the exhaust piping. Furthermore, cooling water streaming out of the first part of the exhaust piping in front of the pinion box contributes to substantially enclosing the space 11 between the two parts of the exhaust piping between these parts and a water curtain preventing both exhaust gases and sound from penetrating outwards through the water curtain. Thanks to this the exhaust gases will be effectively sucked down and outwards through the propeller 7 and simultaneously with this the noise level is considerably reduced.

In order to achieve a water curtain connected as well as possible to the pinion box the connection 8'' of the first part of the exhaust piping is preferably embodied so that the pipe section there is considerably wider than the height of the pipe section, i.e. it has a considerably greater extension perpendicularly to the plane of the paper than in this. The front portion of the housing surrounding the start of the second part of the exhaust piping can preferably be bow-shaped to contribute to the separation of the cooling water from the exhaust gases and, moreover, to prevent the let-out cooling water from sprinkling into the second part of the exhaust piping.

What is claimed is:

1. Marine drive means comprising a water-cooled internal combustion engine mounted in a boat, a shield mounted on the transom stern of the boat and supporting a universal joint housing and a pinion box connected to said universal joint housing and comprising a propeller arranged to be immersible in water, an exhaust outlet arranged in the propeller, an exhaust piping connected between the engine and the exhaust outlet and carrying off exhaust and cooling water from the engine, said exhaust piping comprising a first part passing from the engine through the shield and associated with a second part passing through the pinion box and ending at the exhaust outlet, the connection between the first and the second part of the exhaust piping being open at least partly in order to unload the pressure in the piping and to let out cooling water, the size of the opening between the first and the second part of the exhaust piping being such that substantially all cooling water leaves the exhaust piping through the opening, and the connection between the first and the second part of the exhaust piping being formed in that the first part of the exhaust piping terminates in a substantially horizontal pipe section where at least one part of the lower wall portion of this pipe section is removed and that the second part of the exhaust piping at the connection to the first part is formed as a pipe section which is substantially upwardly open towards the remaining upper part of the first horizontal pipe section.

2. The marine drive means of claim 1, the cross-sectional area of the first part of the exhaust piping increasing from the engine towards the connection to the second part of the exhaust piping.

3. The marine drive means of claim 2, the cross-sectional area of the second part of the exhaust piping being smaller than the cross-sectional area of the first part of the exhaust piping.

4. The marine drive means of claim 1, the dimension of the exhaust outlet in the propeller being such that a negative pressure is created in the second part of the exhaust piping at the rotation of the propeller.

5. The marine drive means of any one of claims 1, 2, 3 or 4, the width of the opening of the pipe section of the first part of the exhaust piping being greater than the height of the pipe section.

6. The marine drive means of claim 1, in which there is a horizontal distance between the end of the lower pipe wall of the pipe section of the first part of the exhaust piping and the side of the pipe section of the second part of the exhaust piping facing this and that, furthermore, the pipe section of the second part of the exhaust piping projects upwards so that the opening of this is located higher than the lower part of the first pipe section.

7. Marine drive means comprising a water-cooled internal combustion engine mounted in a boat, a shield mounted on the transom stern of the boat and supporting a universal joint housing and a pinion box connected to said universal joint housing and comprising a propeller arranged to be immersible in water, an exhaust outlet arranged in the propeller, an exhaust piping connected between the engine and the exhaust outlet and carrying off exhaust and cooling water from the engine, said exhaust piping comprising a first part passing from the engine through the shield and associated with a second part passing through the pinion box and ending at the exhaust outlet, the connection between the first and the second part of the exhaust piping being open at least partly in order to unload the pressure in the piping and to let out cooling water, the size of the opening between the first and the second part of the exhaust piping being such that substantially all cooling water leaves the exhaust piping through the opening and the dimension of the exhaust outlet in the propeller being such that a negative pressure is created in the second part of the exhaust piping at the rotation of the propeller, the connection between the first and the second part of the exhaust piping being formed in that the first part of the exhaust piping terminates in a substantially horizontal pipe section where at least part of the lower wall portion of this pipe section is removed and that the second part of the exhaust piping at the connection to the first part is formed as a pipe section which is substantially upwardly open towards the remaining upper part of the first horizontal pipe section.

* * * * *